United States Patent [19]

Goss et al.

[11] 4,061,230

[45] Dec. 6, 1977

[54] CRANE CROSSHEAD ASSEMBLY MOUNTED ON A PEDESTAL

[75] Inventors: John B. Goss; William D. Morrow, both of Houston, Tex.; Jack William Corbett, Lafayette, La.

[73] Assignee: Pedestal Crane Corporation

[21] Appl. No.: 647,367

[22] Filed: Jan. 8, 1976

[51] Int. Cl.[2] ..... B66C 23/84

[52] U.S. Cl. ..... 212/70; 212/58 R

[58] Field of Search ..... 212/28, 58 R, 66–70, 212/8 R; 308/2 R, 3 R, 37, 58, 61

[56] References Cited

U.S. PATENT DOCUMENTS

| | | | |
|---|---|---|---|
| 46,213 | 2/1865 | Burnett | 212/58 R |
| 884,666 | 4/1908 | Kirtland | 212/58 R |
| 2,414,573 | 1/1947 | Wagner et al. | 212/70 |
| 2,825,471 | 3/1958 | Bushman | 212/28 |
| 3,148,778 | 9/1964 | Fox et al. | 212/70 |
| 3,258,130 | 6/1966 | Mieville | 212/68 |

FOREIGN PATENT DOCUMENTS

| | | | |
|---|---|---|---|
| 1,195,918 | 7/1965 | Germany | 212/70 |
| 2,025,169 | 12/1971 | Germany | 308/3 R |

*Primary Examiner*—Robert J. Spar
*Assistant Examiner*—Carl Rowold
*Attorney, Agent, or Firm*—Pravel, Wilson & Gambrell

[57] ABSTRACT

In a crane having a boom adapted to be mounted on a pedestal, a crane mounting system having a crosshead assembly and a bearing means, the crosshead assembly for connection to the crane boom and adapted to be rotatively mounted in proximity to the upper end of the pedestal and the bearing means allowing rotation and limited pivotal movement of the crosshead assembly with respect to the pedestal.

5 Claims, 7 Drawing Figures

54
56
14a
46
34
36
52
52
58
32
48
30
50
26
140
14b
12
14
28
14c
24
22
74
90
76
A
64
74
66
72
S
10a
144
10
142
18
20
40
52
42
38
44
78
14d
18b
60
136
100
62
16
10c 4
4
22
A
90
74
74
64
76
66
72
S
68
10a
20a
18a
10
18
20
3
3
20b
18b
102
100
10c
16

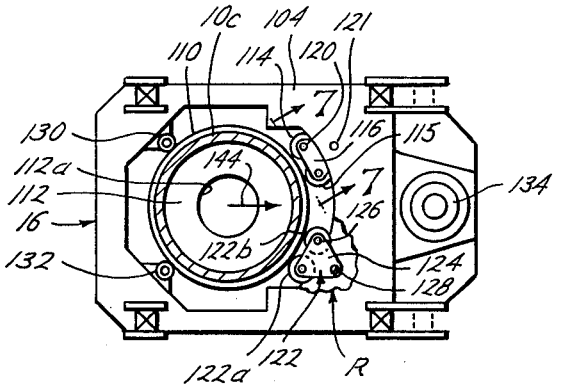
Fig. 3
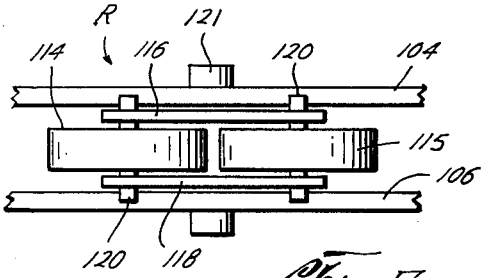
Fig. 7
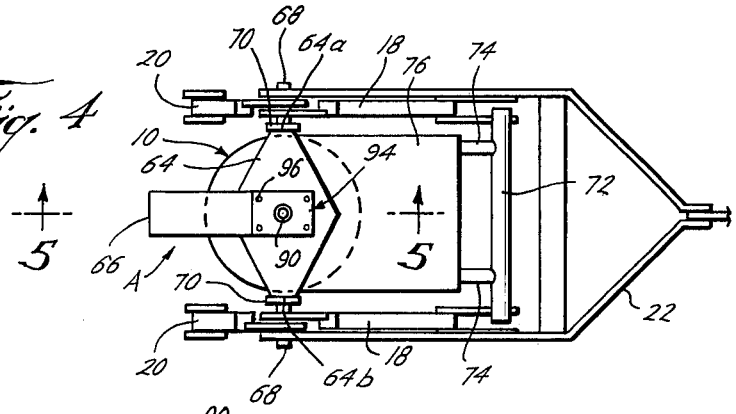
Fig. 4
Fig. 5
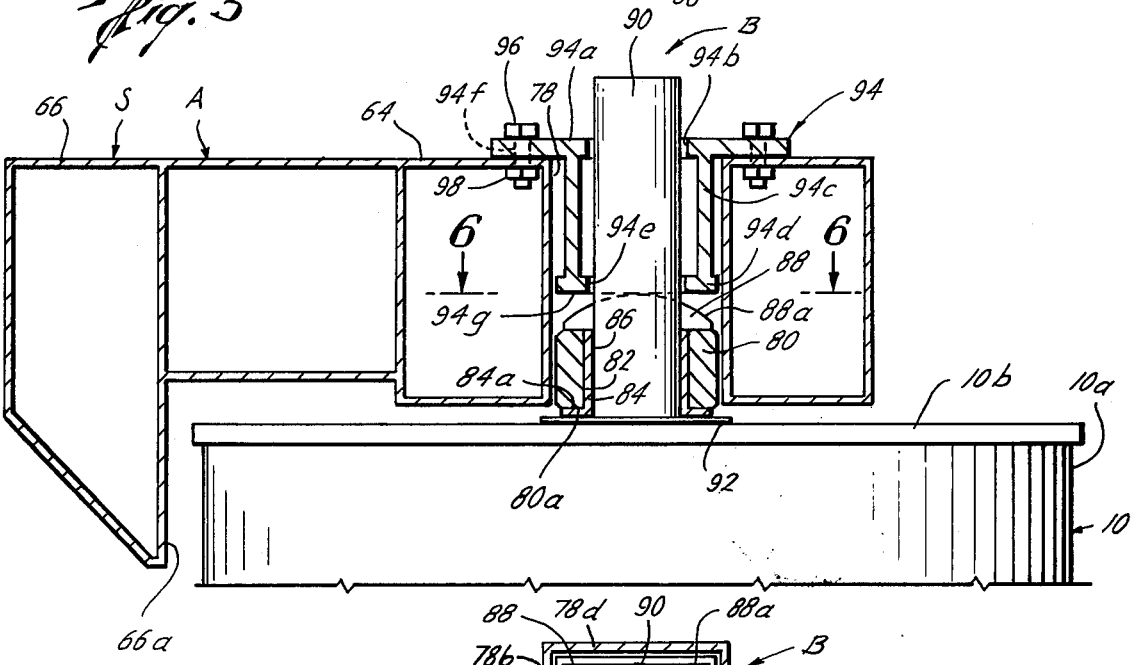
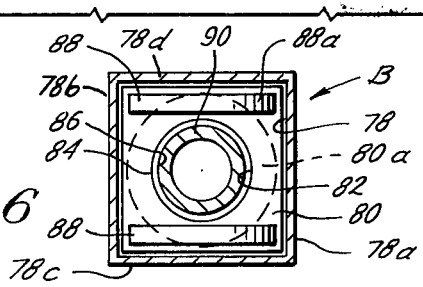
Fig. 6

CRANE CROSSHEAD ASSEMBLY MOUNTED ON A PEDESTAL

BACKGROUND OF THE INVENTION

The field of this invention is crane mounting systems, particularly of the type used for mounting a crane with a pedestal.

Prior art crane mounting systems for cranes adapted to be disposed on a pedestal typically require the use of a large, machined shear ball bearings mounted on or adjacent the upper perimeter of the pedestal which are required to provide for rotation of the crane about the pedestal as well support the crane against all stresses and strains encountered due to loading on the crane boom. Should an overload condition manifest itself and/or should bearing failure result, accidents may result with the crane becoming detached from the pedestal and typically resulting in injury or death to the operator.

SUMMARY OF THE INVENTION

The present invention relates to a new and improved crane mounting system for use in a crane adapted to be mounted on a pedestal. The crane mounting system of the present invention preferably includes a crosshead assembly for connection to the crane boom and adapted to be rotatively mounted in proximity to the upper end of the pedestal and a bearing device with the upper end of the pedestal allowing for rotation and limited pivotal movement of the crosshead assembly with respect to the pedestal.

BRIEF DESCRIPTION OF THE DRAWINGS

FIG. 3 is a plan view of the platform of the crane, partly in section, taken along the lines 3—3 of FIG. 2;

FIG. 4 is a plan view of the crosshead assembly of the crane mounting system of the present invention, as taken along the lines 4—4 of FIG. 2;

FIG. 5 is an enlarged elevational view, partly in section, of the crosshead assembly of the present invention as taken along the lines 5—5 in FIG. 4;

FIG. 6 is a plan view of the bearing means of the crane mounting system of the present invention, partly in section, as taken along the lines 6—6 of FIG. 5; and, FIG. 7 is an elevational view of the roller means of the crane mounting system of the present invention, as taken along the lines 7—7 in FIG. 3.

DESCRIPTION OF THE PREFERRED EMBODIMENT

Figures 1, 2:
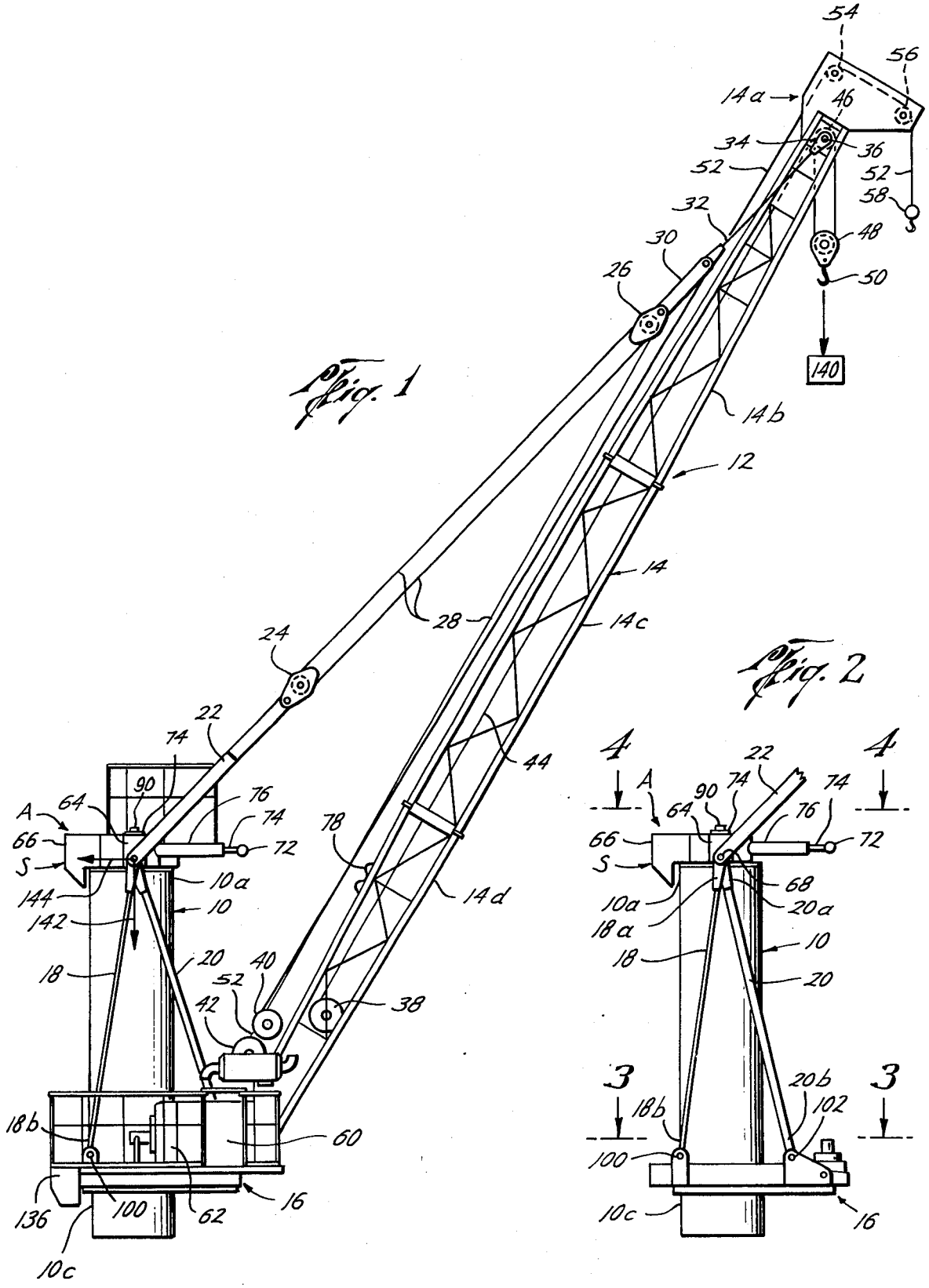
FIG. 1 is an elevational view of a pedestal crane showing the crane mounting system of the present invention as used with the pedestal crane.
FIG. 2 is an elevational view, similar to FIG. 1, showing the primary features of the crane mounting system of the present invention.

In the drawings, the letter C designates the crane mounting system of the present invention. The crane mounting system C is adapted to be mounted on a pedestal 10 and has a crosshead assembly A for supporting a crane, designated generally 12, and adapted to be rotatively mounted in proximity to the pedestal 10. The crane mounting system C further includes bearing means with the pedestal 10 for allowing rotation of the crosshead assembly A about the pedestal 10 and for permitting limited pivotal movement of the crosshead assembly A with respect to the pedestal 10. Unless otherwise noted, the components of this invention are made of steel capable of taking heavy stresses and strains without failure, although other suitable high-strength materials may be used if desired.

As shown in FIG. 1, the crane 12 preferably includes a boom 14 as movably affixed to platform 16 which is adapted to be disposed about the pedestal 10. The pedestal 10 may be mounted with an offshore platform, permanently embedded in the ground, mounted with a movable vehicular frame or in any other way rigidly affixed to a supporting structure (not shown). The platform 16 is supported by support members 18, 20 which are affixed at upper ends **18*a*, 20*a* to the crosshead assembly A which is mounted in proximity to the upper end 10*a* of the pedestal 10 and at lower ends 18*b*, 20*b* to the platform 16. Boom support 22 having sheave 24 mounted therewith and sheave 26 mounted with the boom 14 having lines 28 therebetween provide for support for the boom 14 during lifting operations as well as provides for the proper boom angle of the boom 14 with respect to the horizontal. As is shown in FIG. 1, sheave 26 is mounted with support member 30 having line 32 and connector 34 therewith such that the connector 34 may be appropriately pinned to the boom tip 14*a* of the boom 14 adjacent pin joint 36**.

Preferably, the boom 14 is made up of multiple boom sections **14*b*, 14*c*, 14*d* and may accommodate more or less sections according to the desired length of the boom 14 necessary. As shown in FIG. 1, boom section 14*d* is suitably mounted with the platform 16. Boom section 14*d* provides the support and mount for the load hoist 38, boom hoist 40 and optional fast-line hoist 42. Load line 44 extends from the load hoist 38 over appropriate sheaving means 46 located adjacent the boom tip 14*a* and is operatively connected with block 48 having hook 50 therewith. In similar fashion, fast-line 52 is connected with the fast-line hoist 42 and extends therefrom to the boom tip 14*a* over sheaves 54, 56 to an appropriately weighted hook arragement 58. Further, boom hoist 40 is connected with boom line 28 which runs therebetween boom hoist 40, sheaves 26, 24 for operatively changing the relative boom angle of the boom 14. The mounting of hoists 38, 42 on boom section 14*d* allows the boom 14 to be raised and/or lowered while the relative distance of the hooks 50, 58 from the boom tip 14*a*** remains substantially constant.

The platform 16 preferably provides adequate space for the heavy equipment necessary for crane operation. For example, an appropriate engine 60 may be mounted thereon platform 16 to provide motive power for a hydraulic pump 62 which provides fluid power for operation of hoists 38, 40, 42. Of course, should the hoists 38, 40, 42 be electrically operative, the engine could provide power to a generator (not shown) located in the same position as hydraulic pump 62 to provide the proper electric motive power for powering the same. Still further, the engine 60 provides necessary power for rotating the crane 12 about the pedestal 10 as described more fully hereinbelow. The platform 16 further provides an appropriate location for the controls necessary for the operator to manipulate and control the crane 12. Preferably, the location may be in similar location as where the engine 60 is disposed except upon the corresponding opposing side of the platform 16 (not shown).

The crane mounting system C of the present invention is adapted to mount the above-described crane 12 with the pedestal 10. The crosshead assembly A is mounted with the upper end 10*a* of the pedestal 10 for connection to the boom 14 and is adapted to be rotatively mounted in proximity to the upper end of the pedestal 10. Bearing means B with the upper end 10*a* of the pedestal 10 allows for rotation of the crosshead assembly A about the longitudinal axis of the pedestal 10. The crosshead assembly A includes a central portion 64 and a depending hook 66 formed therewith. The central portion 64 may be of any suitable configuration, however, as shown in FIG. 4, the central portion 64 is preferably of a general parallelogram configuration. Support pins 68 are mounted with the central portion 64 adjacent corner portions 64*a*, 64*b* by support plates 70. The support pins 68 as mounted with the central portion 64 extend beyond the outer diameter of the pedestal 10 such that support members 18, 20 mounted with platform 16 are appropriately connected with the crosshead assembly A for proper support of the platform 16 upon such support pins 68. Furthermore, support pins 68 are used to mount boom support 22 with the crosshead assembly A. Thus, any movement of the crosshead assembly A results in a similar responsive movement in both the platform 16 and the boom 14 therewith. The crosshead assembly A may further include a boom stop 72 (FIGS. 1, 2) appropriately affixed by members 74 to boom stop support plate 76 which is appropriately affixed to the central portion 64 of the crosshead assembly A. The boom stop 72 is adapted to be received in boom stop receiving plate 78 mounted on section 14*d* of the boom 14 such that damage to the boom 14 and/or the crane 12 may be prevented if and when the boom 14 should inadvertently be raised to such a vertical position that the boom 14 may contact the crosshead assembly A, the pedestal 10 or in some way damage the boom 14.

The central portion 64 of the crosshead assembly A includes an opening 78 formed centrally thereof (FIG. 5). Preferably, the opening 78 is of a substantially rectangular configuration having sides 78*a*, 78*b*, 78*c* and 78*d* as shown in FIG. 6 and adapted to receive the bearing means B as described in further detail hereinbelow.

The bearing means B includes a mounting plate 80 preferably of a rectangular configuration having an opening 82 formed therein, being preferably of a circular configuration. A bushing 84, preferably of brass, and having a central bore 86 therein is adapted to be disposed in the opening 82 formed in the mounting plate 80. The bushing 84 is not only mounted within the opening 82 but also has a depending annular lip 84*a* which engages the lower annular surface 80*a* of the mounting plate 80. A pair of arcuate sections 88 are mounted on mounting plate 80 in spaced relationship from the longitudinal axis of the opening 82 and bore 86 which are in substantial alignment with each other.

A support column 90 is mounted to a mounting plate 92 which in turn is mounted to the upper surface 10*b* of the upper end 10*a* of the pedestal 10 such that the support column 90, being preferably of a tubular configuration, has its longitudinal axis in substantial alignment with the longitudinal axis of the pedestal 10. The tubular nature of support column 90 allows for the crane controls (not shown) to be located remote from the crane 12 with the appropriate connections therebetween the controls and the crane 12 running through the central portion of the column 90. The support column 90 is adapted to be receivably mounted within the bore 86 of the bushing 84 such that the mounting plate 80-bushing 84-arcuate sections 88 assembly may rotate thereabout the fixed, support column 90.

Retainer plate 94 (FIG. 5) is formed having an upper plate 94*a* having an opening 94*b* formed centrally therewith, an extension support member 94*c*, and a lower plate 94*d* having a centrally formed opening 94*e* formed therewith. The retainer plate 94 is preferably of a rectangular configuration and adapted to be receivably mounted within the rectangular opening 78 formed in the central portion 64 of the crosshead assembly A. The upper plate 94*a* has a plurality of bolt openings 94*f* adapted to receive bolts 96 and their corresponding nuts 98 to removably mount the retainer plate 94 with the central portion 64 having suitable openings (not shown) corresponding to bolt openings 94*f*. Extension member 94*c* joins the upper plate 94*a* and the lower plate 94*d* together such that opening 94*b* and opening 94*e* are in an aligned relationship to one another such that the support column 90 extends therethrough and centrally of both openings 94*b*, 94*e*. Surface 94*g* of the lower plate 94*d* is adapted to rest upon the upper arcuate surfaces 88*a* of the arcuate sections 88.

Thus, the longitudinal axis of the pedestal 10, the longitudinal axis of the support column 90, the longitudinal axis of the bushing 84, and the longitudinal axis of the openings 94*b*, 94*e* of the retainer plate 94 are all in substantial axial alignment. Furthermore, mounting plate 80 and lower plate 94*d* of retainer plate 94 are adapted to be disposed within the rectangular opening 78 formed in the central portion 64 of the crosshead assembly A. This configuration allows the crosshead assembly A to rotate about the longitudinal axis of the pedestal 10 in proximity to the upper end 10*a* thereof. The arcuate sections 88 are mounted in a spaced relationship from the longitudinal axis of the pedestal 10 at the upper end 10*a* thereof and provide a means for limited pivotal movement of the crosshead assembly A relative to the longitudinal axis of the pedestal. Due to the engagement of surface 94*g* with upper arcuate surfaces 88*a*, the crosshead assembly A can pivot relative to the longitudinal axis of the pedestal 10 towards and away from the boom 14. It should be noted that openings 94*b*, 94*e* are oversized to accommodate this pivotal motion without the retainer plate 94 contacting the support column 90. Furthermore, inasmuch as the mounting plate 80 and the lower plate 94*d* of the retainer plate 94 are not in an interference relationship within the rectangular opening 78, the crosshead assembly A may move laterally from side 78*a* to side 78*b* or from side 78*c* to side 78*d* of opening 78. Thus, the bearing means B provides for three separate types of movement of the crosshead assembly A with respect to the pedestal 10, namely, rotational movement, pivotal movement, and/or lateral movement.

A further feature of the retainer plate 94 is that while the crane 12 is fully intact having the crosshead assembly A therewith, the mounting plate 80-bushing 84-arcuate sections 88 assembly may be replaced without necessitating the removal of the entire crosshead assembly A. The bolt-nut assembly 96, 98 is merely removed while the entire crosshead assembly A is allowed to either rest upon the upper surface 10*b* of the pedestal 10 and/or is supported by an appropriate supportive mechanism such as a jack, or the like (not shown). The retainer plate 94 may be removed and the assembly is thereafter accessible for removal and/or repair in the event of bearing failure without requiring removal of the crosshead assembly A. Many prior art devices require larger more expensive cranes to lift the entire crane off of its bearing should such bearing replacement be necessary, particularly if the crane be of the type requiring the use of shear ball bearings. However, the retainer plate 94 allows removal of this assembly for repair and/or replacement should such be necessary without the need to remove the entire crane structure therefrom the pedestal 10.

As noted hereinabove, the platform 16 is supported by support members 18, 20 appropriately affixed to the crosshead assembly A at their respective upper ends 18*a*, 20*a* by support pins 68 (FIG. 2) while supporting the platform 16 with pinned connections 100, 102 adjacent the respective lower ends 18*b*, 20*b* of support members 18, 20. As shown in FIGS. 3 and 7, the platform 16 is preferably of a multiple-layer construction including an upper surface 104 and a lower surface 106. Both surfaces 104, 106 have a suitably formed opening therein adapted to accommodate disposition of the pedestal 10 therein. The support members 18, 20 result in the platform 16 being disposed about the midsection 10*c* of the pedestal 10. A roller path 110 is suitably mounted with the midsection of the pedestal 10, the roller path 110 being preferably a flat band suitably affixed to the outer perimeter of the pedestal 10 adjacent the mid-section 10*c*. An interior support 112 is preferably mounted within the pedestal 10 adjacent the midsection 10*c* and the roller path 110. Preferably, the support 112 has a bore 112*a* within for permitting servicing of the interior portion of the pedestal 10 below the midsection 10*c*. For example, when the pedestal 10 is affixed to its base (not shown), typically the pedestal 10 is welded from within the pedestal about the inner, base periphery to its base. The bore 112*a* allows passage within the pedestal 10 for such installation and maintenance.

Roller means R is mounted with the platform 16 and is adapted to rollably engage the roller path 110 to facilitate rotation of the platform 16 about the midsection 10*c* of the pedestal 10 as the crosshead assembly A rotates about the bearing means B for coordinated, aligned rotation of the crosshead assembly A and the platform 16 about the pedestal 10. Preferably, the roller means R includes at least one pair of rollers 114, 115 that are mounted in a fixed spaced relation to one another preferably by means of roller mounting plates 116, 118 which have suitable openings formed therein allowing the insertion of pins 120 to allow rotational mounting of the rollers 114, 115 with plates 116, 118. The rollers 114, 115 as mounted in plates 116, 118 are preferably pivotally mounted with the upper and lower surfaces 104, 106 of the platform 16 by means of pin 121 such that the roller assembly may pivot with respect to the platform 16 about pin 121. Preferably, roller means R includes a second pair of rollers 122 mounted with the platform 16 in a similar fashion, having rollers 122*a*, 122*b* being rotationally mounted with plate 124 by pins 126, with the entire assembly being pinned to the platform 16 by pin 128.

Idler rollers 130, 132 are preferably disposed in an opposed relationship to rollers 114, 115, 122*a*, 122*b* with idler rollers 130, 132 being rollably affixed to platform 16 such that they may engage the roller path 110. This assembly of rollers allows the platform 16 to rotate thereabout the midsection 10*c* of the pedestal 10 on the roller path 110 in such a fashion that the pedestal 10 need not be of a machined, precisely circular configuration as would be necessitated by the use of a shear ball bearing-type structure. On the contrary, the roller means R of the present invention allows the platform to rotate about the pedestal 10 with the pivotal mounting of the roller means R allowing articulation of the rollers as they travel about the roller path 110. Therefore, any surface irregularities of the pedestal 10 and/or the roller path 110 are compensated for by the articulation of the rollers about pins 121, 128 as the platform 16 rotates thereabout the midsection 10*c*.

The platform 16 further provides a housing for the slewing drive 134 which drives a chain (not shown) which engages the chain sprocket (not shown) mounted with the outer periphery of the pedestal 10 adjacent the midsection 10*c* thereof for imparting motive force to rotate the platform 16 and the entire crane 12. Still further, the platform 16 provides a housing for hydraulic tanks 136 and the like.

In the event of bearing failure and/or failure of the support column 90, the depending hook 66 mounted with the crosshead assembly A acts as a safety means S for preventing separation of the crosshead assembly A from the pedestal 10 if such failure should occur during the operation of the crane. In such an event, the depending hook surface 66*a* engages the upper end 10*a* of the pedestal 10 and prevents the crane from toppling over with the ensuing risk of injury and/or death to the operator thereof.

Numerous advantages are inherent in manufacturing the crane mounting system C in accordance with the present invention. Due to the construction techniques of the bearing means B and the maintenance of low-level tolerances, no exact machining is necessary and, quite to the contrary, inexpensive techniques such as torch cutting and grinding are satisfactory for machining the arcuate sections 88, the mounting plate 80, the retainer plate 94, and the like. Still further, due to the articulation of the roller means R about the perimeter of the pedestal 10 when the platform 16 rotates thereabout, any irregularities in the pedestal-roller path 110 configuration are further compensated therefor. Thus, the crane mounting system C of the present invention lends itself most suitably to inexpensive manufacturing techniques as compared to the highly machined-critical tolerance levels commonly found in those units requiring the use of a large, shear ball bearings.

As shown in FIG. 1, any load 140 lifted by the hooks 50, 58 will result in a horizontal and vertical reaction at the support pins 68 which is transmitted through the central portion 64 of the crosshead assembly A to the support column 90 whereupon the entire vertical component of the load 140 is reacted upon and supported by the pedestal 10 by reaction force schematically shown acting in the direction of arrow 142. A portion of the horizontal component 144 of the load 140 is reacted upon by the support column 90 while the remaining horizontal component 144 of the load 140 is reacted upon by the roller means R acting at the midsection 10*c* of the pedestal 10 (FIG. 3). Thus, the roller means R reacts against a portion of the horizontal component only in the direction of arrow 144 and need not react vertically, as would be necessary in those cranes requiring a use of a shear ball bearing. Thus, the roller means provides the horizontal reaction necessary to equalize those horizontal components of the load 140 while the support column 90 acting through the pedestal 10 provides the necessary vertical component reactive force for proper support of the crane 12 and the load 140 therewith as well as a portion of the horizontal component reactive forces.

Thus, the crane mounting system C of the present invention enables use of a crane 12 that may be safely mounted with a pedestal 10 having appropriate safety means S preventing separation of the crane 12 from the pedestal 10 as well as providing multiple degrees of freedom for the rotating crosshead assembly A enabling one to manufacture the crane mounting system C of the present invention by means of inexpensive manufacturing techniques.

The foregoing disclosure and description of the invention are illustrative and explanatory thereof, and various changes in the size, shape and materials as well as in the details of the illustrated construction may be made without departing from the spirit of the invention.

We claim:

1. In a crane having a boom adapted to be mounted on a pedestal, the pedestal having an upper end, a crane mounting system comprising:

a crosshead assembly for connection to the crane boom and adapted to be rotatively mounted in proximity to the upper end of the pedestal;

bearing means with the upper end of the pedestal for allowing rotation of said crosshead assembly about the longitudinal axis of the pedestal, said bearing means including a pair of arcuate sections mounted with the upper end of the pedestal in spaced relationship from the longitudinal axis of the pedestal at the upper end of the pedestal for providing for limited lateral and pivotal movement of said crosshead assembly relative to the longitudinal axis of the pedestal;

a support column mounted with the upper end of the pedestal and extending upwardly therefrom, with the longitudinal axis of said support column being in substantial alignment with the longitudinal axis of the pedestal, said support column being receivably mounted between said arcuate sections, said crosshead assembly being rotatably mounted about said support column; and, a substantially rectangular mounting plate for mounting said arcuate sections therewith and having an opening formed centrally thereof, said plate adapted to be disposed about said support column with said support column being within said opening of said mounting plate, said mounting plate being mounted within a rectangular opening centrally formed in said crosshead assembly for limited lateral movement of said crosshead assembly with respect to the pedestal.

2. The mounting system of claim 1, further including:

retaining means for securing said bearing means with said crosshead assembly and the pedestal, said retaining means being removably mounted with said rectangular opening formed in said crosshead assembly and allowing removal of said bearing means without necessitating the removal of said crosshead assembly from the pedestal.

3. The mounting system of claim 1, wherein the pedestal has a midsection, further including:

a platform having an opening formed centrally thereof, said platform adapted to be mounted adjacent the midsection of the pedestal with the pedestal extending therethrough said opening in said platform, said platform supported by said crosshead assembly and said platform having the crane boom mounted therewith at boom mounting points.

4. The mounting system of claim 3, further including:

roller means mounted with said platform, said roller means adapted to rollably engage the midsection of the pedestal to facilitate rotation of said platform about the midsection of the pedestal as said crosshead assembly rotates about said bearing means for coordinated, aligned rotation of said crosshead assembly and said platform about the pedestal, said roller means including:

two pairs of pivotal rollers, each pair of said pivotal rollers being mounted in a fixed spaced relation to one another and pivotally mounted with said platform adjacent said boom mounting points for engaging the midsection of the pedestal, said pivotal rollers providing horizontal loading support due to loading on the crane against reaction loading components acting in a direction substantially perpendicular to the longitudinal axis of the pedestal at the midsection thereof and substantially perpendicular to said pivoting axis; and, two fixed rollers, each mounted about said opening of said platform substantially 180° from each of said pivotal rollers in a plane vertically intersecting said pivotal rollers and substantially parallel to the vertical plane passing through the longitudinal axis of the crane boom.

5. The mounting system of claim 1, further including:

safety means mounted substantially perpendicular to and with said crosshead assembly for preventing separation of said crosshead assembly from the pedestal should said bearing means fail during the operation of the crane.

* * * * *